US005604812A

United States Patent [19]

Meyer

[11] Patent Number: 5,604,812

[45] Date of Patent: Feb. 18, 1997

[54] PROGRAMMABLE HEARING AID WITH AUTOMATIC ADAPTION TO AUDITORY CONDITIONS

[75] Inventor: Wolfram Meyer, Moehrendorf, Germany

[73] Assignee: Siemens Audiologische Technik GmbH, Erlangen, Germany

[21] Appl. No.: 385,695

[22] Filed: Feb. 8, 1995

[30] Foreign Application Priority Data

May 6, 1994 [EP] European Pat. Off. ..... 94107143

[51] Int. Cl.[6] ..... H04R 25/00

[52] U.S. Cl. ..... 381/68.2; 381/68

[58] Field of Search ..... 381/23.1, 60, 68, 381/68.2, 68.4; 128/746; 73/585

[56] References Cited

U.S. PATENT DOCUMENTS

| | | |
|---|---|---|
| 4,471,171 | 9/1984 | Köpke et al. . |
| 4,947,432 | 8/1990 | Tφpholm . |
| 5,040,215 | 8/1991 | Amano et al. . |
| 5,202,927 | 4/1993 | Tφpholm . |
| 5,303,306 | 4/1994 | Brillhart et al. . |

FOREIGN PATENT DOCUMENTS

| | | |
|---|---|---|
| 0132216 | 1/1985 | European Pat. Off. . |
| 0064042 | 1/1986 | European Pat. Off. . |
| 0537026 | 4/1993 | European Pat. Off. . |
| 0578019 | 1/1994 | European Pat. Off. . |

*Primary Examiner*—Curtis Kuntz
*Assistant Examiner*—Huyen D. Le
*Attorney, Agent, or Firm*—Hill, Steadman & Simpson

[57] ABSTRACT

For continuous, automatic and autonomous adaptation of its transmission characteristics, a hearing aid includes in addition to a microphone, earphone and amplifier/transmission circuit, a first data memory in which audiometric data are stored, a second data memory in which hearing aid characteristics are stored, a third data memory in which algorithms are stored, a signal analysis unit that determines control signals dependent on input quantities characteristic of the current ambient situation, and also includes a data processing unit, the data processing unit offering hearing aid setting data for the amplifier/transmission circuit from the data of the data memories and from the control signals of the signal analysis unit, so that the transmission characteristics of the amplifier/transmission circuit can be automatically determined from the edited audiometric data, hearing aid characteristics, prescribable algorithms and the input quantities characteristic of the current ambient situation.

11 Claims, 3 Drawing Sheets

PROGRAMMABLE HEARING AID WITH AUTOMATIC ADAPTION TO AUDITORY CONDITIONS

BACKGROUND OF THE INVENTION

1. Field of the Invention

The present invention is directed to a programmable hearing aid, having an amplifier and transmission circuit that can be set to various transmission characteristics for altering its transmission properties between the microphone and earphone.

2. Description of the Prior Art

European Application 0 064 042 discloses a circuit arrangement for a hearing aid wherein the parameters for eight different ambient situations, for example, are stored in a memory in the hearing aid itself. By actuating a switch, a first group of parameters is retrieved and used to control the signal processor, connected between the microphone and earphone, via a control unit. This signal processor sets a first transmission function intended for a predetermined auditory environment. All eight transmission functions can be successively retrieved via the switch until that which is best suited at the moment has been found. Moreover, an automatic switching among permanently programmed transmission functions is provided when the user moves, for example, from a noisy environment into a quiet environment or vice versa. This switching also ensues cyclically (serially). When one wishes to set transmission functions other than the stored transmission functions, the non-volatile memory must be erased by an external programming unit and must be reprogrammed by the programming unit.

German OS 36 42 828 also discloses a remotely controlled, programmable hearing aid having an amplifier and transmission circuit that can be optionally set to different transmission characteristics for altering its transmission properties between the microphone and earphone. This known hearing aid has an external control device with a transmitter for the wireless transmission of control signals to the hearing aid, and a receiver located in the hearing aid for reception and demodulation of control signals. In this hearing aid, a base transmission characteristic is permanently set in the individual units of the transmission channel from the microphone to the earphone. Other transmission characteristics are stored in an external control device and can be optionally selected by actuating a switch or a push button and can be transmitted to the receiver provided in the hearing aid by the transmitter integrated in the external device. These signals received by the hearing aid serve—after demodulation and corresponding processing—the purpose of setting the different transmission characteristic of the hearing aid between the microphone and earphone for adaptation to one of a number of ambient situations stored in the external control device, for example in the form of control parameters. These control parameters are calculated from the audiogram of the wearer and from simulated ambient situations and are stored in the control device. The audiogram is thereby lost, i.e. it can no longer be reproduced. The same is true of the data representing the ambient situations. In particular, how these control parameters were calculated cannot be reconstructed after the calculation takes place.

German OS 32 05 685 discloses a hearing aid that can be programmed by the wearer, i.e., it can be set to his or her own hearing impairment and can be possibly reprogrammed given a change in the hearing impairment. To this end, the hearing-impaired person can successively retrieve a test program of test tones stored a memory in the hearing aid and the wearer can actuate a switch when the desired (appropriate) hearing threshold is reached, and thus effect the storing of a correction factor for the respective test tone. After storing these correction factors, a built-in microprocessor then calculates the valid transmission characteristic from the normal program stored in a memory and from the correction factors, this transmission characteristic being retained until the wearer reprograms the hearing aid in the same way. An adaptation to constantly changing ambient situations is thereby neither provided nor possible, not even by remote control.

German OS 39 00 588 discloses a remote control device for the wireless control of hearing aids, wherein the external remote control device contains a first memory for the acceptance and storing of audiometric data, a second memory for the acceptance of data identifying different ambient situations, and data processing means for calculating groups of control parameters from the audiometric data and from the data identifying the ambient situation according to one or more algorithms that are stored in a third memory in combination with the data processing means. Data allocated to the individual ambient situations can be respectively retrieved from the second memory using a keyboard, for calculating the corresponding group of control parameters. A microprocessor is provided in the external control device as the data processing means. The hearing aid can be programmed with the control parameters calculated in the control device, and thus can be permanently set for a specific ambient situation.

SUMMARY OF THE INVENTION

It is an object of the present invention to provide a programmable hearing aid that can be autonomously matched to the changing ambient situations taking stored, audiometric data, characteristic values associated with the hearing aid components, and prescribable algorithms into consideration.

The above object is achieved in accordance with the principles of the present invention in a programmable hearing aid having an amplifier and transmission circuit, which is adjustable to different transmission characteristics, connected between a microphone and an earphone, a first data memory in which audiometric data are stored, a second data memory in which characteristic data of the hearing aid are stored, a third data memory in which algorithms are stored, a signal analysis unit which determines control signals dependent on input quantities which characterize a current ambient auditory situation, and a data processing unit which provides hearing aid setting data for the amplifier and transmission circuit from the data stored in the data memories and from control signals generated by the signal analysis unit, so that the transmission characteristics of the amplifier and transmission circuit are automatically and autonomously determined from the processed audiometric data, the hearing aid characteristic data, the algorithms, and the input quantities which are characteristic of the current ambient auditory situation.

The signal analysis unit is connected to the microphone, so that the input quantities which characterize the current ambient auditory situation are directly determinable by the signal analysis unit, without the signal analysis unit having to be "instructed" or "informed" by the wearer of the hearing aid. The ability of the programmable hearing aid of the invention to proceed on its own with the selection and setting of the transmission characteristics for the amplifier and transmission circuit, without human intervention, is encompassed within the meaning of "automatically and autonomously," as used herein.

As a result of the constant re-identification or recalculation of the setting parameters on site, i.e., in the hearing aid, a constant and continuous, automatic follow-up of the hearing aid setting to match the possibly constantly changing ambient conditions is achieved.

In order to also take personal data, instructions and impressions of the hearing aid wearer into consideration in the adaptation of the signal processing of the hearing aid, in a further development of the invention unsharp inputs of the hearing aid wearer can be stored in a fourth data memory of the hearing aid, and the data processing unit in the hearing aid has a fuzzy logic module allocated to it. The fuzzy logic module offers hearing aid setting data for the amplifier and transmission circuit calculated from the current data and signals from the unsharp inputs of the hearing aid wearer, from resulting signals from the audiometric data, from the characteristic data of the hearing aid or the stored algorithms as well as, potentially, from the control signals of the signal analysis stage via the data processing unit.

By hardwired and/or wireless transmission of information (data) to the hearing aid, the fuzzy logic module thereof can subsequently calculate optimum setting parameters for the hearing aid and automatically and optimally set these parameters. By contrast to known hearing aid adaptation systems, the inventively communicated data are not composed of direct setting parameter sets. The hearing aid of the invention has no memory wherein a plurality of direct hearing aid settings are stored for various ambient situations. The hearing aid setting optimally matched to the respective ambient situation is neither pre-stored in the hearing aid nor is it communicated [to the hearing aid]; it is calculated in the hearing aid and directly influences the signal processing of the hearing aid. The data information communicated wirelessly and/or by a hardwired connection contains general information with respect to the ambient conditions as well as with respect to individual impressions, instructions and personal (hearing impairment) data of the hearing aid wearer.

The offering of the information for the fuzzy logic can also ensue in a mixed form, i.e. the individual impressions of the hearing aid wearer can be wirelessly transmitted to the hearing aid with remote control, whereas the criteria for prevailing ambient conditions can be automatically calculated in the hearing aid and forwarded together with the transmitted, individual impressions to the fuzzy logic and are processed therein. The personal data of the hearing aid wearer can be both wirelessly communicated or can be stored in the hearing aid itself on the basis of programming.

Further, the hearing aid can be implemented so that connection to a trainable system, for example, a neural network, is possible, such a connection being possible both wirelessly or as a hardwired connection. In a hardwired embodiment, the trainable system is a component of the hearing aid. The function of the trainable system is to generate fuzzy rules (configuration information of the fuzzy logic module) and/or the prescribed processing rules (algorithms). After the end of the individual or general training phase, the calculated behavior rules and/or the configuration information are implemented in the hearing aid. The implementation can ensue wirelessly and/or hardwired. Manual or automatic statements about the ambient situation, about individual impressions and instructions of the hearing aid wearer, as well as the personal audiometric data can be consulted for calculating the behavior rules. Even after the completed implementation of the behavior rules, individual impressions and instructions as well as information with respect to the ambient behavior can be supplied to the control unit contained in the hearing aid for the purpose of calculation or utilization. The delivery of this information can again ensue wirelessly and/or hardwired connection.

DESCRIPTION OF THE PREFERRED EMBODIMENTS

Figure 1:
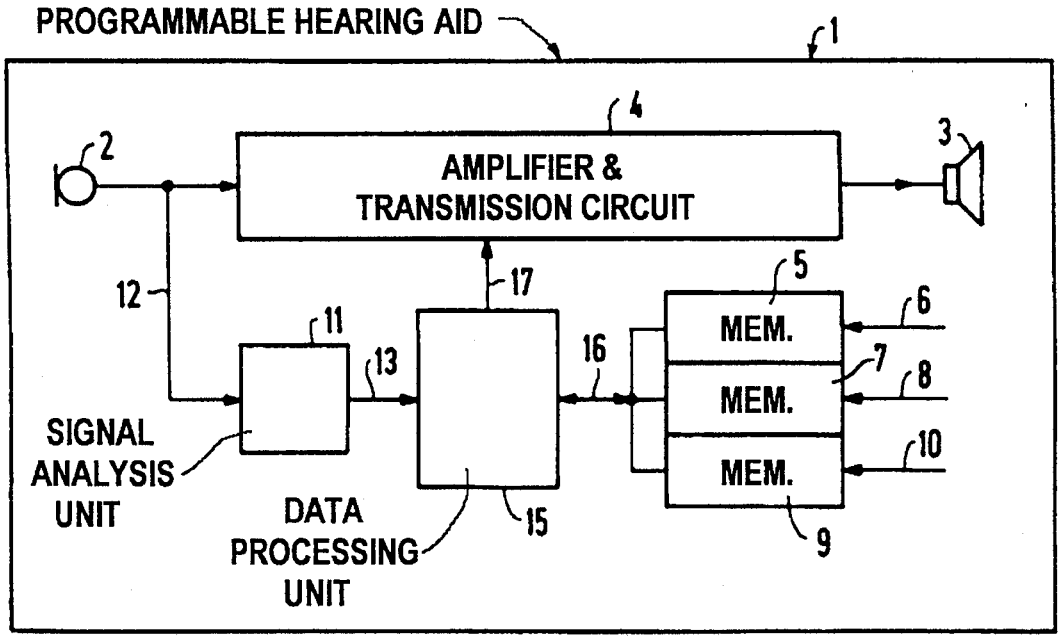
FIG. 1 is a block circuit diagram of an inventive programmable hearing aid that with autonomous, continuous and automatic follow-up of its signal processing means to changing ambient situations.

The hearing aid 1 of the invention schematically shown in FIG. 1 picks up acoustic signals via a microphone 2. This acoustic information is converted into electrical signals in the microphone 2. After a signal processing in an amplification and transmission circuit 4, the electrical signal is supplied to an earphone 3 serving as the output transducer. In order to avoid an additional acoustic transducer or some other sensor, at least one input or measured quantity 12 that represents a quantity characterizing the respective (current) ambient situation/auditory situation are taken from the signal path between the microphone 2 and the earphone 3 according to this exemplary embodiment. The hearing aid 1 further includes a first data memory 5 wherein audiometric data 6, which the audiologist measures at the hearing-impaired person, are stored. The hearing aid 1 also contains a second data memory 7 wherein hearing aid characteristic data 8 associated with the hearing aid components and prescribed by the hearing aid manufacturer are stored. Finally, algorithms 10 that contain the processing rules for calculating hearing aid setting data 17 are stored in a third data memory 9 in the hearing aid 1. The hearing aid 1 contains a data processing unit 15, for example, a microprocessor, and a signal analysis unit 11 for the data memories. The input quantities 12 are analyzed in this signal analysis unit 11 and are supplied to the data processing unit 15 as control signals 13 that identify the current ambient/auditory situation. By evaluating and processing the data 6, 8 and 12, 13 as well as taking the algorithms 10 in the hearing aid 1 into consideration, the programmable hearing aid of the invention undertakes a continuous, automatic and autonomous adaptation of its transmission characteristics to changing ambient situations. Control parameters 17 are calculated or identified in the hearing aid 1 by collaboration of the data processing unit 15 with the signal analysis 11 and the data memories, 5, 7 and 9, these control parameters 17 defining or co-influencing the respective transmission characteristic of the hearing aid 1 when transmitted to the amplifier and transmission circuit 4.

Figure 2:
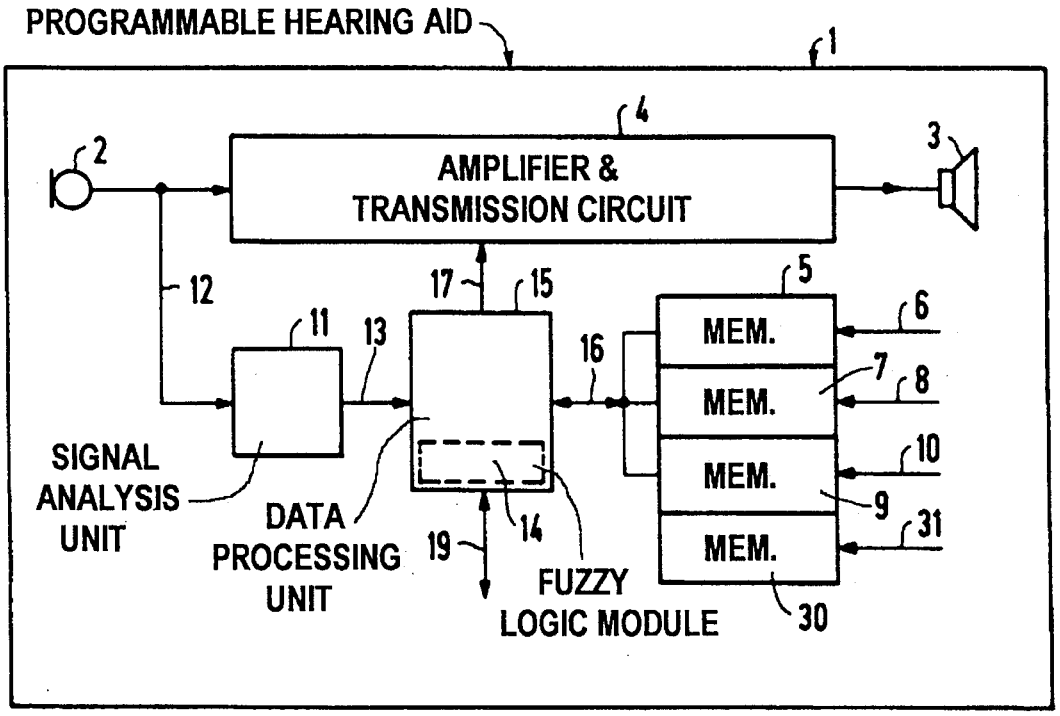
FIG. 2 is a block circuit diagram of an inventive hearing aid that also takes unsharp inputs of the hearing aid wearer into consideration in the adaptation of the transmission characteristics, in addition to considering stored audiometric data, characteristic data of the hearing aid and algorithms, wherein the data processing unit of the hearing aid comprises a fuzzy logic.

In the embodiment of FIG. 2, personal inputs 31 of the hearing aid wearer are also taken into consideration in the identification of the transmission characteristics of the hearing aid 1. These inputs can be impressions of the hearing aid wearer about the prevailing ambient conditions and/or about the volume of the signal processing of the hearing aid, for example, too loud, too soft, etc. These data, referred to as unsharp inputs 31, can be stored in a fourth memory 30 of the hearing aid 1.

Additionally, a fuzzy logic module 14 is allocated to the data processing unit 15 of the hearing aid 1 of FIG. 2. Such a fuzzy logic module 14 can comprise components or stages (not shown) for implementing the fuzzy logic operations of fuzzification, inference formation and defuzzification in a known way and can also contain at least one control unit or one rule base, whereby processing rules or configuration information 19 can be stored on a data carrier (not shown) of this rule base in fetchable fashion. Given application of these processing rules 19, the fuzzy logic module 14 and the allocated data processing unit 15 identify the hearing aid setting data 17 that can be supplied to the amplifier and transmission circuit 4 from the unsharp inputs 31 and the signals 16 resulting from the data 6, 8 and 10 of the data memories 5, 7 and 9 as well as from the control signals 13 of the signal analysis 11. A fuzzy logic module can likewise be provided as the signal analysis unit 11 for the evaluation of the input quantities 12 and for forming the control signals 13 therefrom.

Figure 3:
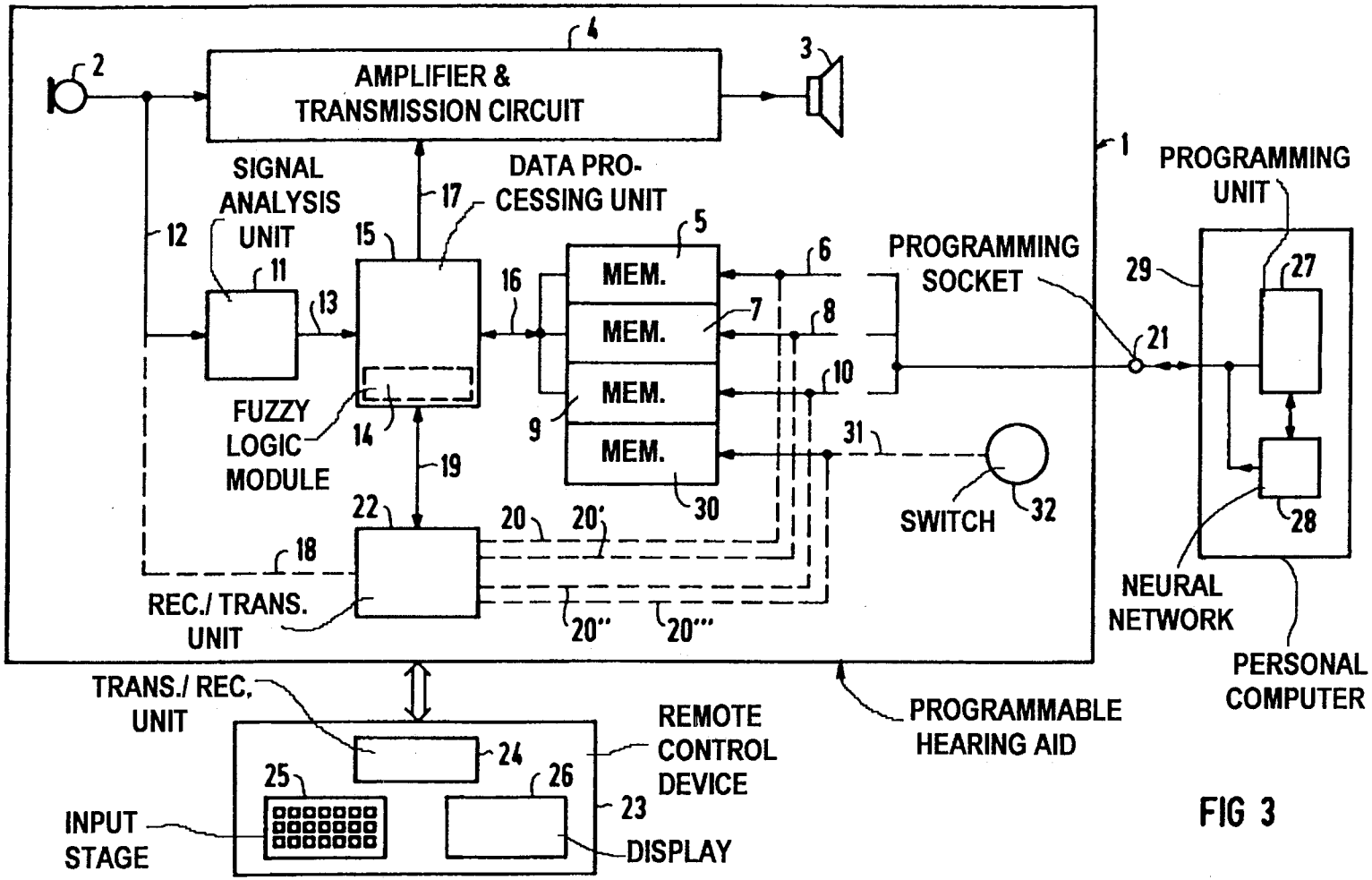
FIG. 3 is block circuit diagram of a programmable hearing aid of the invention that can communicate with a programming device and/or a remote control device.

According to the embodiment of FIG. 3, the hearing aid 1 has a programming socket 21 for data and algorithm entry as well as for the entry and retrieving of the configuration information. Further, a receiver/transmitter unit 22 is provided in the hearing aid 1 for data and algorithm entry and/or for entry and retrieved of the configuration information.

A remote control device 23 having a transmitter/receiver unit 24, an input stage 25 and a display 26 can also be provided for transmission to the hearing aid 1 and/or for the read-out of one or more of the audiometric data 6, the hearing aid characteristics 8, the algorithms 10, the unsharp inputs 31 or the configuration information 19.

Alternatively, the programming unit 27, for example a personal computer 29 that can be connected to the programming sockets 21 of the hearing aid 1, can serve for the transmission and/or for the read-out of the data 6, 8 and 10 and/or of the data 19. It is advantageous for the programming unit 27 to be trainable, which is accomplished by providing it with a neural network 28.

In a further embodiment, the hearing aid 1 has a switch 32 actuatable by the hearing aid wearer for the transmission of the unsharp inputs 31 to the fourth data memory 30. The switch 32, for example, can be a plus/minus key, a multiple touch key, of a sliding switch, a rotary switch or the like.

As shown in FIG. 3, the receiver/transmitter unit 22 of the hearing aid 1 can be connected via an input 18 to the signal path from the microphone 2 to the amplifier and transmission circuit 4, and the unit 22 has electrical connections 20, 20', 20", 20'" to the data memories 5, 7, 9 and 30.

Figure 4:
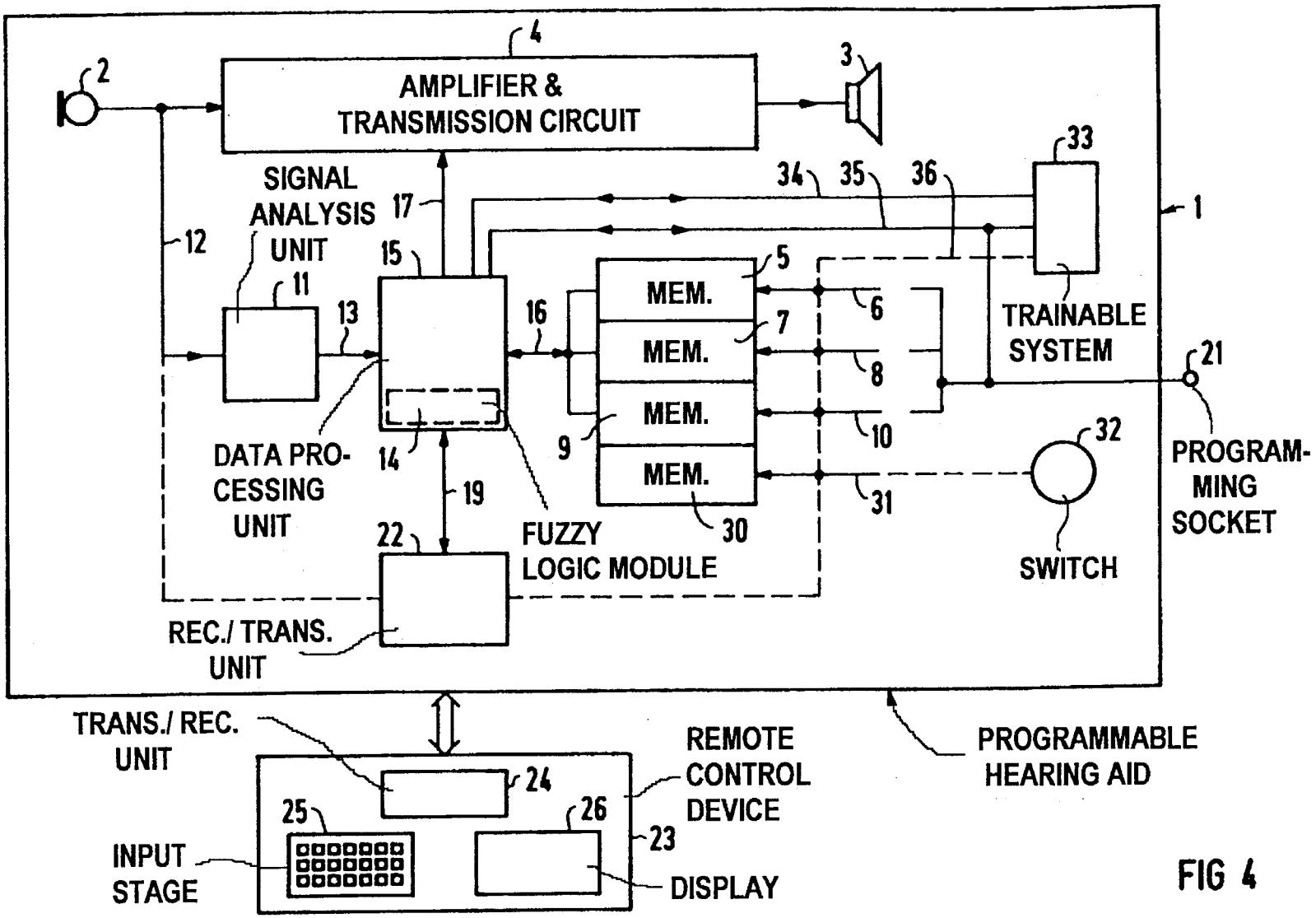
FIG. 4 is a block circuit diagram of the programmable hearing aid of FIG. 3 that additionally includes a trainable system (neural network).

The programmable hearing aid of FIG. 4 has a trainable system 33 that is provided for generating algorithms and/or configuration information 19 for use by the fuzzy logic module 14. This trainable system or neural network 33 of the hearing aid 1 has access to the data memories 5, 7, 9 and 30 via an interface or may be directly connected to the data processing unit 15, or to the receiver/transmitter unit 22 of the hearing aid 1. The trainable system 33 thus can communicate generated algorithms and/or generated configuration information through the data processing unit 15 or to the rule base of the fuzzy logic 14.

Although modifications and changes may be suggested by those skilled in the art, it is the intention of the inventor to embody within the patent warranted hereon all changes and modifications as reasonably and properly come within the scope of his contribution to the art.

I claim as my invention:

1. A programmable hearing aid comprising:

a microphone which receives incoming audio signals;

an earphone which emits output audio signals produced from said incoming audio signals;

amplifier and transmission means connected between said microphone and said earphone, and being adjustable to different transmission characteristics, for producing said output audio signals from said incoming audio signals;

first data memory means for storing audiometric data;

second data memory means for storing characteristic data of said hearing aid;

third data memory means for storing algorithms;

signal analysis means connected to said microphone, for generating control signals, dependent on said incoming audio signals, which characterize a current ambient auditory situation; and data processing means, connected to said signal analysis means, said first, second and third data memory means, and said amplifier and transmission means for automatically and autonomously generating setting data for setting said transmission characteristics of said amplifier and transmission means dependent on said audiometric data, said characteristic data of said hearing aid, said algorithms and said control signals characterizing said current ambient auditory situation.

2. A programmable hearing aid as claimed in claim 1 further comprising:

fourth data memory means for storing unsharp inputs provided by a wearer of said hearing aid, said fourth data memory means being connected to said data processing means; and fuzzy logic means, contained in said data processing means, for generating said setting data for said amplifier and transmission means by operating on said audiometric data, said characteristic data of said hearing aid, said unsharp inputs, said algorithms and said control signal according to rules of fuzzy logic.

3. A programmable hearing aid as claimed in claim 2 further comprising switch means, actuatable by said hearing aid wearer, for entering unsharp inputs into said fourth data memory means.

4. A programmable hearing aid as claimed in claim 2 wherein said fuzzy logic means comprises data memory means for storing said fuzzy logic rules, and control means to which the respective data from said first, second, third and fourth memory means and said control signals are supplied and connected to said data memory means for fetching said fuzzy logic rules therefrom.

5. A programmable hearing aid as claimed in claim 4 further comprising receiver means for wirelessly receiving data for, and for transmitting said data to, the respective first, second and third memory means, for wirelessly receiving said unsharp inputs and for transmitting said unsharp inputs to said fourth data memory means, and for wirelessly receiving said fuzzy logic rules and for transmitting said fuzzy logic rules to said data memory means of said fuzzy logic means.

6. A programmable hearing aid as claimed in claim 5 further comprising remote control means for entering said data into said first, second and third data memory means and for entering said unsharp inputs into said fourth data memory means and for entering said fuzzy logic rules into said data memory means of said fuzzy logic means, including wireless transmitter means for communicating with said receiver means.

7. A programmable hearing aid as claimed in claim 4 further comprising programming socket means for receiving data for, and transmitting said data into, the respective first, second and third memory means, for receiving said unsharp inputs and for transmitting said unsharp inputs to said fourth data memory means, and for receiving said fuzzy logic rules and for transmitting said fuzzy logic rules to said data memory means of said fuzzy logic means.

8. A programmable hearing aid as claimed in claim 7 further comprising a programming unit containing neural network means, connected to said programming socket, for transmitting at least one of said audiometric data, said data characterizing said hearing aid, said algorithms and said fuzzy logic rules to said data processing means.

9. A programmable hearing aid as claimed in claim 2 further comprising trainable means for generating at least one of said algorithms and said fuzzy logic rules.

10. A programmable hearing aid as claimed in claim 9 wherein said trainable means is connected each of said first, second, third and fourth data memory means via said programming socket means for using the data stored in each of said first, second, third and fourth data memory means in generating said at least one of said algorithms and said fuzzy logic rules.

11. A programmable hearing aid as claimed in claim 1 wherein said signal analysis means comprises means for operating on said incoming audio signals according to rules of fuzzy logic to generate said control signals.

* * * * *